United States Patent [19]

Giguere

[11] 4,400,923

[45] Aug. 30, 1983

[54] CATCH MEMBER

[75] Inventor: Jean P. Giguere, St-Agapit, Canada

[73] Assignee: Donat Flamand Inc., Lobiniere, Canada

[21] Appl. No.: 298,694

[22] Filed: Sep. 2, 1981

Related U.S. Application Data

[63] Continuation of Ser. No. 93,367, Nov. 13, 1979, abandoned.

[30] Foreign Application Priority Data

Jul. 18, 1979 [CA] Canada ..... 332045

[51] Int. Cl.[3] ..... E06B 7/70

[52] U.S. Cl. ..... 52/455; 411/508; 292/76

[58] Field of Search ..... 52/311, 314, 455, 509, 52/507; 292/76, 17, DIG. 73; 411/71, 73, 508; 24/73 PC

[56] References Cited

U.S. PATENT DOCUMENTS

| | | | |
|---|---|---|---|
| 508,999 | 11/1893 | Tobey | 292/76 |
| 815,638 | 3/1906 | Sandberg | 292/76 |
| 3,221,462 | 12/1965 | Pomeroy | 52/509 |
| 3,254,465 | 6/1966 | Brengman | 292/76 |
| 3,276,167 | 10/1966 | Bus | 49/485 |
| 3,385,157 | 5/1968 | Rapata . | |
| 3,438,112 | 4/1969 | Labruyere | 52/788 |
| 3,680,177 | 8/1972 | Ginsberg | 24/73 PC |
| 3,811,725 | 5/1974 | Bauer | 292/76 |

FOREIGN PATENT DOCUMENTS

| | | | |
|---|---|---|---|
| 2007161 | 11/1970 | Fed. Rep. of Germany | 292/76 |
| 1315418 | 12/1962 | France | 411/71 |

*Primary Examiner*—John E. Murtagh
*Assistant Examiner*—Henry E. Raduazo
*Attorney, Agent, or Firm*—Wolder, Gross & Yavner

[57] ABSTRACT

A catch member adapted to be secured to the end of a grille member for securing same to a window parallel to the inner surface thereof. The window sash presents inwardly facing surfaces which have longitudinally extending shallow grooves forming seats of the catch members. The catch members comprise a stem and a head portion integrally formed therewith. The head portion has a base from whose lower surface the stem depends, and an arcuate arm flexibly secured to the base along one edge thereof. The arcuate arm overlies the base and its major portion is spaced apart from the upper surface of the base whereby it can yield when the window grille is being fitted to or removed from the window. The arcuate arm is curved in one direction and flat in the opposite direction.

15 Claims, 11 Drawing Figures

CATCH MEMBER

This is a continuation of application Ser. No. 93,367, filed Nov. 13, 1979, and now abandoned.

This invention relates to the art of window fabrication, and in particular to means for removably retaining a decorative grille against the inside surface of a window.

When it is desired to obtain the appearance of old style windows in modern window construction, interconnected strips of wood forming a lightweight decorative grille are applied against the inside surface of the glass pane. When cleaning the window the grille must be removed. Various types of connectors have been used in the past to removably secure a decorative window grille to the window sash. One type of connectors consists of two or more swivel clips secured to the window sash or moulding strip, each swivel clip having a projection which overlies the adjacent end of a grille member. An other form of connector comprises two or more securing nails having a hemispherical head driven into the inwardly directed surface of the moulding strip and a corresponding member of spring clips secured to the ends of the grille members and adapted to form seats for the heads of the adjacent securing nails.

The above noted modes of connection are objectionable in many respects. The swivel clips take time to install and are necessarily apparent which partly defeats the purpose of the window grille, namely to give the real appearance of traditional multiple pane windows. The small wood screws which retain the swivel clips to the window sash or moulding close to the inner edge thereof tend to split the wood even if care is taken to drill a hole for each screw, thus causing permanent and visible damage. The use of securing nails and associated metal spring clips results in a neat appearance if the clips are recessed in the ends of the grille members, and if the nails have been positioned with great care and accuracy which is time consuming and demanding from a quality control point of view in mass production. Moreover when replacing the grille after window cleaning or repair it is essential that the grille be reinstalled in its original position on the same window otherwise the clips may not register properly with the securing nails and the grille members will either tend to fall off or will no longer be at right angle.

I have found that these shortcomings can be overcome by mounting a resilient grille clip or catch member of particular design at both ends of a grille member, which cooperate with a longitudinal shallow groove in the inwardly facing surface of the window sash or moulding strip. The catch member has an arcuate arm with a smooth outer surface, resiliently connected to a supporting base portion which in turn comprises a stem adapted to be received and secured into a longitudinal bore in the end of the grille member in such a manner as to prevent axial and pivotal movement of the arcuate arm relative to the grille member.

This mode of connection provides excellent results at minimal costs. Such connectors do not require recessing and are invisible, and there is no danger of wood splitting or wood scratching even when thin sash members or moulding strips made of soft wood are used. Leveling of the grille members when required may be effected by the homeowner and this operation is easily carried out by hand without any tools. Proper positioning obtains even if grilles of the same size are interchanged or reinstalled in a different orientation. These catch members may be mass produced, and their cost is negligible especially if they are made of plastic molding. The securing of the catch members to opposite ends of grille members is a simple operation requiring no skilled labor.

In use, a decorative grille installed on a window in accordance with my invention does not tend to fall even if tampered with by small children. The grille members if made with sufficient care will automatically assume proper alignment when installed on the window, and the resiliency of the catch members prevents displacement or vibration of the grille relative to the window.

In accordance with this invention I provide a catch member for mounting a decorative grille to a window whose sash presents along at least two opposite sides thereof an inwardly facing shallow groove extending parallel to the plane of the window glass pane, the catch member comprising an elongate stem and a convex head portion disposed over one end of the stem in a T-shaped configuration. The head portion consists of a relatively broad base and a convex arm overlying the base and connected to one edge thereof generally in a flattened C-shaped configuration, the groove engaging surface of said arm being smooth, flat in one direction and curved in the direction transverse to said one direction.

I also provide a catch member which is a one piece molded component made of rigid plastic material whose stem is of constant cylindrical cross-section having at least three longitudinally extending radial ribs of constant cross-section. The convex arm extends over and slightly beyond the base; it is relatively thin so as to be flexible in the direction normal to the base but the portion of the arcuate arm which overlies the base is spaced apart from the upper surface of the base over a distance which is sufficient to permit resilient displacement of the free end portion of the arcuate arm toward the base whenever the decorative grille unto which said catch member is mounted is being installed in position against the inside surface of the window.

Preferably the radius of the arc described by the arcuate arm is slightly longer than the greatest distance between the base and the arcuate arm resulting in a relatively broad curve at the upper surface of the head portion of the catch member.

In practice these catch members are not subjected to very substantial loads and consequently they may be easily mass produced by the well known injection plastic molding process, the thickness of the base being about constant and equal to that of the arcuate arm which thickness may be of the order of one millimeter for a head portion whose projection defines a square measuring about ten millimeters along each side thereof.

For proper anchoring of the catch member to an edge of a grille member, the stem of the catch member which is integrally formed with the head portion of the catch member is preferably of constant circular cross-section and has three or more longitudinally extending radial ribs of triangular cross-section of very limited constant height.

Moreover, in order to facilitate insertion of the decorative grille with the catch members mounted thereto, the upper surface of the arcuate arm extends downwardly and outwardly toward the lower surface of the base in order to define therewith a wedge shaped nose portion. The region of the arcuate arm which merges into the base is of gradually increasing thickness in order to provide sufficient strength and prevent premature failure of the catch member due to concentration of flexing efforts at the root of the arcuate arm.

This invention also provides the combination of a rectangular window sash made of four sash members, a glass panel supported within the window sash, a decorative window grille consisting of at least one elongate grille member adapted to extends across the glass panel against the inside surface thereof, and a pair of resilient catch members secured to opposite ends of the grille member and adapted to cooperate with two opposite sash members in order to retain the grille member to the window sash. The two opposite sash members extend parallel to one another and have along their respective inner edge a relatively narrow window grille anchoring surface disposed adjacent the inside surface of the glass panel and extending essentially perpendicularly to the glass panel. Each window grille anchoring surface has a longitudinally extending shallow groove of constant cross-section. Each catch member comprises a head portion and means for securing the catch member to an end of the grille member while the head portion has a base whose inner surface is adapted to bear against the end surface of the grille member and a resilient arm formed integrally with the base and displaceable relative to said base along an axis extending through the catch member longitudinally of said grille member, the resilient arm having its outer surface smooth and being so shaped as to remain captive within the shallow grooves of the opposite sash members when the grille member is mounted in place to said window sash. Preferably the shallow grooves are arcuate in cross-section and the outer surface of the arcuate arm of the catch members generally conforms to the shallow grooves. With a decorative grille consisting of an assembly of interconnected strips of wood of essentially rectangular cross-section arranged into a grid configuration, at least two parallel ones of the strips will have catch members secured to their opposite ends.

The invention finds particular application in the case of the combination defined above wherein the window comprises a wooden sash made of two vertical sash members and two horizontal sash members interconnected at their ends to form a rectangular sash and defining a seat for receiving the glass panel which glass panel consists of an assembly of at least two parallel juxtaposed glass panes, and wherein a wooden moulding strip secures the glass panes into the wooden sash of the window. In this arrangement it is relatively easy to provide a shallow groove along the inwardly facing surface of the wooden moulding strip for receiving the arcuate arms of the catch members mounted to opposite ends of the desired decorative window grille.

Such catch members find other applications, namely: securing a screen frame to a window, or retaining a hinged closure panel such as cabinet door to the closed position.

Thus, this invention also provides the combination of a catch member as noted above with a movable component supporting at one end thereof the catch member, and a fixed member adapted to retain the adjacent portion of the movable component against displacement in a direction which is perpendicular to the movable component. The fixed member has a narrow surface parallel to and facing the edge of the movable component where the catch member is supported. The narrow surface has a longitudinally extending shallow groove which defines the seat for the head portion of a catch member which is so disposed that upon closing the movable member toward the fixed member the straight edge or nose portion constitutes the leading edge of the catch member.

In the accompanying drawings which illustrate a preferred embodiment according to this invention, FIG. 1, is a front elevational view of a rectangular casement window which supports a decorative window grille;

Figure 1:
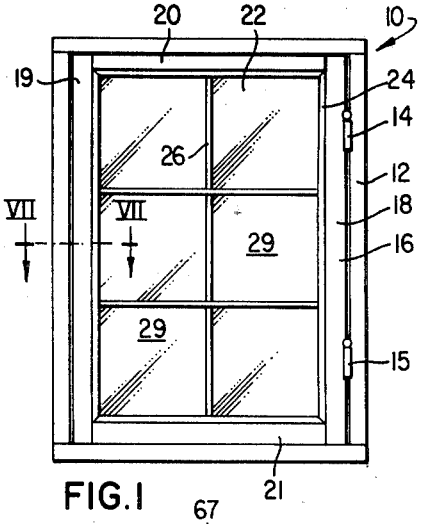

Referring now to the Figures of drawings, particularly to FIG. 1 thereof, a rectangular window is illustrated at reference numeral 10 which comprises a fixed frame 12 to which is hinged as at 14 and 15 a window sash 16 comprising two parallel spaced apart vertical sash members 18 and 19 and two horizontally extending sash members 20 and 21 to which is secured a glass pane 22 retained in place by means of a suitable moulding strip 24.

Figure 7:
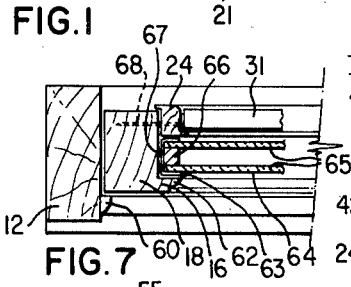
FIG. 7, is a cross-sectional view taken along line VII—VII of FIG. 1.

In FIG. 1, the inside surface of the window is shown as having a decorative window grille 26 disposed immediately adjacent the inside surface of glass pane 22 for the purpose of giving the appearance of a window made of relatively small rectangular glass panes as at 29. Preferably the decorative grille 26 is spaced a short distance inwardly of the inside surface of glass pane 22 as shown in FIG. 7 in order to prevent local temperature gradients.

Figure 2:
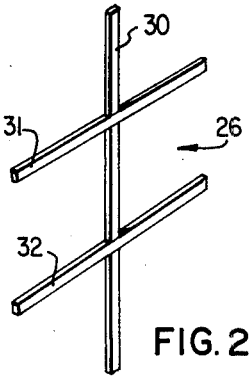
FIG. 2, is a perspective view of a decorative window grille similar to that shown in FIG. 1.

The decorative window grille 26 is better illustrated in FIG. 2 in perspective view as consisting of one vertical component 30 and two spaced apart parallel transverse members 31 and 32 secured to the vertical strip 30 at their center. Usually such decorative window grilles are made of relatively thin strips of soft wood of constant rectangular cross-section resulting in a very lightweight and fragile structure which however must be removed from the window for cleaning purposes.

Figure 3:
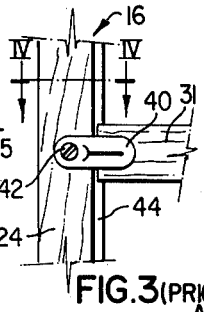
FIG. 3 (PRIOR ART)
FIG. 3, is a front elevational view of a portion of a window illustrating a prior art method of connecting a window grille to a window.
Figure 4:
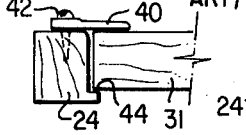
FIG. 4 (PRIOR ART)
FIG. 4, is a cross-sectional view taken along line IV—IV of FIG. 3.

For retaining the window grille 26 to the window sash 16 or moulding strip 24 thereof, one prior art method is illustrated in FIGS. 3 and 4 as comprising a swivel clip 40 which is secured by means of a small wood screw 42 driven into the moulding strip 24 of the window sash, and the positioning of swivel clip 40 is such that its free end extends over the adjacent end of transverse member 31 of decorative window grille 26. Transverse member 31 of window grille 26 is held captive between the under surface of the swivel clip 40 and a shoulder 44 provided along the inner edge of moulding strip 24.

As noted above this prior art method presents the major inconvenience that the swivel clip takes time to install (accurate positioning, drilling, screwing) and the clip remains apparent which partly defeats the purpose of the decorative window grille which is to create as much as possible the appearance of old style multiple pane windows. At manufacturing those windows designed to receive a decorative grille require special preparation, and the distributors must have in stock two varieties of windows namely plain ones and others prepared with a decorative grille. An other disadvantage results from the fact that in most cases moulding strip 24 consists of a relatively narrow strip of soft wood such as pine or cedar which tends to split in the area adjacent the swivel clip due to the wedging effect created by wooden screws 42, and this problem has been found to exist even if a small hole is drilled for each screw 42.

Figure 5:
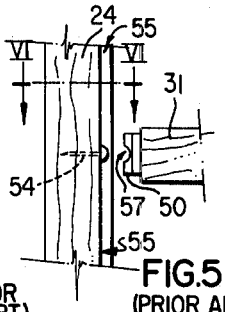
FIG. 5 (PRIOR ART)
FIG. 5, is a front elevational view of a portion of a window illustrating an alternative prior art method of connecting a decorative window grille to the window frame.
Figure 6:
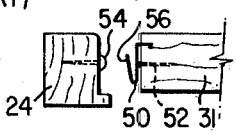
FIG. 6 (PRIOR ART)
FIG. 6, is a cross-sectional view taken along line VI—VI of FIG. 5.

In the alternative method illustrated in FIGS. 5 and 6 a spring clip 50 is secured to the end of cross-member 31 of decorative window grille 26 by means of a tongue 52 which projects through a small hole (not shown) in the end of grille member 31. These spring clips 50 are designed to engage with the hemispherical head of nails 54 which are driven into the inwardly facing surface 55 of moulding strip 24. A small opening or a slot 57 located centrally of the free end portion 56 of spring clip 50 defines a seat for receiving the head of nail 54 and thus retain the decorative window grille 26 in position adjacent the inside surface of the window glass pane. When it is desired to completely hide spring clip 52 a recess therefor (not shown) is cut at each end of grille member 31.

However, it has been determined that in practice it is extremely difficult to properly locate nails 54 along the inwardly facing surface 55 of moulding strips 24 particularly in a mass production assembly line because even the slightest error will result in improper registering of a spring clip 50 with the corresponding nail 54 resulting in improper connection or unacceptable misalignment of the transverse members 31 and 32 of grille 26 with respect to the surrounding components of the window. Moreover with such an arrangement the homeowner must take great care to ensure that whenever the decorative window grilles of identical windows are removed for cleaning purposes they will not be interchanged and they will be replaced exactly in the same position and orientation as they were initially otherwise improper alignment of the members of the window grille will result. This mode of connection obviously also necessitates special preparation of those windows designed to receive a window grille, and consequential duplication of stocks at distribution levels.

As illustrated in FIGS. 8 to 11, the above noted disadvantages are immediately resolved by using catch members secured to opposite ends of cross-members 31 which cooperate with longitudinal shallow grooves provided along the inwardly facing surfaces 55 of moulding strip 24. In order to properly describe FIG. 8 reference may be had to FIG. 7 which is a cross-sectional view taken along line VII—VII of FIG. 1 in the case of a casement type double-glaze wooden window of the type using a thermally insulated glass pane assembly. Fixed frame 12 of window 10 is shown as supporting a window stopper 60 against which the movable frame or sash 16 bears when the window is in the closed position. Sash 16 consists of a wooden sash member 18 provided with an inwardly extending projection 62 for preventing outward displacement of the glass pane assembly 64. A suitable plastic sealer 63 applied in liquid or paste form assures proper sealing of the outside surface of glass pane assembly 64 and sash 16. Glass pane assembly 64 comprises two spaced apart glass panes 65 (FIGS. 7 and 8) insulated from one another by spacer 66 and retained in this position by means of an adhesive and/or a marginal connector 67 which extends all around the glass pane assembly 64. The assembly is retained in place in window sash 16 by means of a moulding strip 24 secured by means of suitable fasteners such as nails, one of which being illustrated in dash lines 68 in FIG. 7. A sealer in liquid or paste form should be applied around moulding strip 24 as at 95 in FIG. 8.

Figure 8:
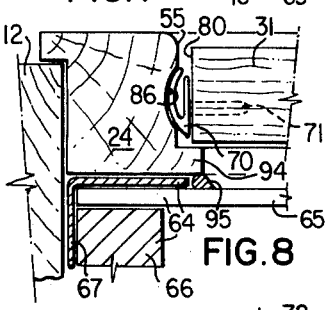
FIG. 8, is an enlarged view of a portion of the cross-sectional view of FIG. 7.

Returning more particularly to FIGS. 8 to 11 it will be seen that the preferred catch member made in accordance with this invention is a one piece molded component 70 made of suitable rigid plastic material comprising a cylindrical stem 71 and a head portion 72 disposed across the stem in a T-shaped configuration (FIGS. 9 and 10). Head portion 72 consists of a broad flat base 73 whose lower surface 74 connects with the adjacent end 75 of stem 71 at exactly 90° relative to the longitudinal axis (not shown) of stem 71 for proper positioning of head portion 72 relative to this axis. An arcuate arm 76 overlies the upper surface 77 of base 73 in a flattened C-shaped configuration. Arcuate arm 76 is relatively thin so as to be flexible in the direction illustrated by arrow 78 in FIG. 10, that is in a direction normal to base 73. The lower surface 74 of base 73 is flat and defines a bearing surface around the stem for contacting the end surface 80 of cross-member 31 as illustrated in FIG. 8. Base 73 has a generally straight edge 81 along which the arcuate arm 76 connects with base 73 defining a wedge shaped nose portion 82 which facilitates insertion of the window grille with catch members 70 in place. Obviously if stem 71 is not perpendicular from lower surface 74 of base 73 from which it projects, it becomes nearly impossible to ensure that once installed its arcuate arm 76 will be perpendicular to the axis of grille member 31 or 32 in the flat direction of upper surface 84 as will be described above.

Figure 10:
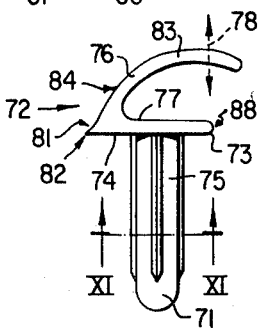
FIG. 10, is a side elevational view of the catch member of FIG. 9.

The portion 83 of the arcuate arm 76 which overlies the base 73 is spaced apart from the upper surface 77 thereof by a distance which is sufficient to allow compression thereof toward base 73 in the direction of arrow 78 when the decorative window grille 26 is being installed and also when the grille is finally received in position against or adjacent the inside surface of glass pane 22. The upper surface 84 of arcuate arm 76 is curved in one direction as shown in FIG. 10 for obtaining a secure yet easily removable connection. This groove engaging surface 84.

Figure 9:
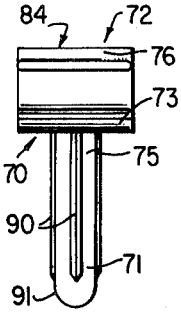
FIG. 9, is a front elevational view of a catch member made in accordance with this invention.

Preferably the shape thereof will be as close as possible to the cross-section of the shallow groove 86 (see FIG. 8) on the inwardly facing surface 50 of moulding strip 24. Groove engaging surface 84 is flat in the opposite direction as shown in FIG. 9 in order to automatically set the grille member at 90° with respect to the moulding strip 24 and prevent scratching of this moulding when mounting or removing the grille. Groove contacting surface 84 must be sufficiently smooth and even in order to reduce friction and thus avoid scratching of the paint or wood finish on moulding strip 24.

Figure 11:
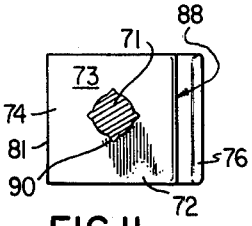
FIG. 11, is a cross-sectional view taken along line XI—XI of FIG. 10.

Arcuate arm 76 is essentially rectangular as best seen in FIG. 11 and it extends from straight edge 81 in an arcuate path over base 73 to a region located beyond and spaced apart from the rearward edge 88 of base 73. The radius of the arc described by the arcuate arm 76 is slightly longer than the greatest distance between the base 73 and the arcuate arm 76 resulting in a relatively broad curve which facilitates insertion of the decorative window grille 26 relative to the window 10, and prevent jamming when removing the grille.

As shown in FIGS. 10 and 11 the thickness of base 73 is essentially constant and equal to that of arcuate arm 76 except at the root of arm 76 where a thicker region is provided in order to prevent premature fatigue of the plastic material in this area where efforts would otherwise tend to concentrate.

Catch members in accordance with this invention are secured to the opposite ends of one and preferably two grille members 31 and 32 (FIG. 2). To this effect longitudinally extending holes (not shown) are drilled into each end of grille member 31 or 32, and the stem of catch members 70 are pressed therein. The holes must be strictly parallel to the axis of the grille member in order to obtain proper seating of base 73 against the end of grille member 31 or 32 and in order to ensure that the groove contacting surface 84 may be perpendicular to the axis of grille member 31 or 32 in its flat direction. If the diameter of the holes receiving stems 71 is equal to the diameter of the circular portions of stem 71, no adhesive is necessary because the radial ribs 90 penetrate the surrounding wood to prevent withdrawal of catch member 70 and avoid all pivotal motion thereof. In the illustrated preferred embodiment four equally spaced apart radial ribs are shown. Three such ribs however should suffice. They are of triangular constant cross-section. It will be seen that ribs 90 terminate short of the free rounded end 91 of stem 71. This configuration is intented to facilitate insertion of the stem 71 into its drilled hole.

In a particular embodiment of this invention the projection of head portion 72 defines a square whose sides measure approximately 10 mm., the thickness of the arm 76 which is identical to that of base 73 is about equal to 1 mm., the diameter of the stem is about 2 mm and its length is equal to about 10 mm. The radius of circle extending through the center of arcuate arm 73 (not shown) is about 6 mm while the center of this circle is located below base 73 rearwardly of stem 71 relative to nose portion 81 that is toward the right hand side of FIG. 10, and the height of ribs 90 is about 0.4 mm. A preferred plastic material is that sold under the trade mark "CELCON" although other suitable plastic materials offering comparable rigidity and freedom from fatigue may be used instead.

It should therefore be apparent particularly with reference to FIG. 8, where the moulding strip 24 is shown in cross-sectional view with an inwardly projecting flange 94 serving as an abutment for window grille 26, that this invention provides a catch member 70 which may be secured to a movable equipment, in particular a window grille 26, for removably retaining same to a fixed member, in particular the sash of a window. This type of catch member may find numerous applications but it has prooved to be of particular interest when used to mount a decorative window grille to a wooden window of the double-glaze, thermally insulated type where a thin moulding strip made of wood is used for retaining the glass pane assembly in place to the sash or frame of the window.

In accordance with this invention it is no longer required to prepare those windows designed to receive a decorative window grille any differently from other windows. Indeed, by using the same grooved moulding strip on all windows the decision to mount a decorative grille or not may be taken even after final installations of the window to its receiving building.

The time consuming tasks of mounting swivel clips of hemispherical head nails to specific places on preselected window units are completely avoid as well as complaints from dissatisfied consumers on account of improper grille fitting, and substantial corresponding cost reductions become available.

The same catch member may be used as a catch member for hinged cabinet doors and for hinged or removable screens as long as a suitable grooved fixed member or moulding has been provided. In the case of a hinged cabinet door (not shown) it is sufficient to provide one or two spaced apart catch members along the edge opposite the hinges. For screens (not shown), where the frame is made of thin frame members, it should be preferable to dispose one catch member as described above at or near each corner of the frame.

The embodiments of the invention in which an exclusive property or privilege is claimed are defined as follows.

1. A one-piece molded catch member made of rigid plastic material, comprising a cylindrical stem and a head portion disposed across said stem in a T-shaped configuration, said head portion consisting of a broad flat base whose lower surface connects with the adjacent end of said stem at a right angle relative to the longitudinal axis of said stem, and an arcuate arm overlying the upper surface of said base in a flattened C-shaped configuration, said arcuate arm having its outer surface smooth, and being relatively thin so as to be flexible in the direction normal to said base, said lower surface of said base being flat and defining a bearing surface around said stem, said base having a generally straight edge along which said arcuate arm connects to said base, the portion of said arcuate arm which overlies said base being spaced apart from the upper surface of said base and being resiliently movable toward said upper surface of said base, the upper surface of said arcuate arm being flat in a first direction parallel to said straight edge and curved in the transverse direction, said stem being essentially solid and rigid and being of constant circular cross-section over substantially all of its length from said base, said stem including at least three and not substantial more than four longitudinal rectilinear ribs of similar cross-section which are parallel to the axis of the stem and which are equidistantly distributed around the periphery of said stem, said ribs being relatively sharp and extending radially outwardly to said stem over a radial distance which is considerably less than the radius of said stem to permit said stem to be inserted into a mounting hole of a diameter equal to the diameter of said cylindrical stem without appreciably stressing the material in which the hole is located and to be retained in the hole without rotating.

2. A catch member as defined in claim 1 wherein said arcuate arm is essentially rectangular and extends from said straight edge in an arcuate path over said base to a region located beyond and spaced apart from the edge of said base which is opposite to said straight edge, the radius of the arc described by said arcuate arm being slightly longer than the greatest distance between said base and said arcuate arm.

3. A catch member as defined in claim 1 wherein the upper surface of said arcuate arm extends downwardly and outwardly toward the lower surface of said base in order to define therewith a wedge shaped nose portion.

4. cA catch member as defined in any one of claims 1, 2 and 3 wherein said base and said arcuate arm are essentially of the same uniform thickness and wherein the end portion of said arcuate arm which is adjacent said nose portion is of gradually increasing thickness where it merges with said base.

5. A catch member as defined in claim 1 wherein said stem is rounded at its free end wherein said ribs start at said base and terminate short of said rounded free end of said stem, the terminal end of each rib being shaped as a ramp.

6. A catch member as defined in claim 5 wherein said ribs are of identical triangular cross-section, thus presenting sharp edges.

7. A catch member as defined in any one of claims 1, 2 and 3 wherein said head portion when viewed from the top, defines a square whose sides measure approximately 10 mm, the thickness of said arcuate arm and of said base being essentially constant and equal to about 1 mm, the diameter of said stem being about 2 mm and its length equal to about 10 mm, wherein the radius of curvature of said arcuate arm is about 6 mm while the center of said circle is located below said base rearwardly of said stem with respect to said straight edge, and wherein said stem comprises four equally spaced apart longitudinally extending radial ribs of constant triangular cross-section the height of said ribs being equal to about 0.4 mm.

8. In combination a catch member as defined in any one of claims 1, 2 and 3, a movable component supporting at one end thereof said catch member by means of said stem and a fixed member adapted to retain the adjacent portion of said movable component against displacement in a direction which is perpendicular to said movable component, said fixed member having a narrow surface parallel to and facing the edge of said movable component where said catch member is supported, said narrow surface having a longitudinally extending shallow groove defining a seat for the head portion of said catch member, and said catch member being so disposed that upon closing said movable member toward said fixed member said straight edge constitutes the leading edge of said catch member.

9. In combination a rectangular window sash made of four sash members, at least one glass panel supported within said window sash, a decorative window grille consisting of at least one elongate grille member adapted to extend across said glass panel against the inside surface thereof and be removably secured to two opposite ones of said sash members and a pair of resilient catch means secured to opposite ends of said grille member and adapted to cooperate with said two opposite sash members in order to retain said grille member to said window sash, said two opposite sash members extending parallel to one another and having along their respective inner edge a relatively narrow window grille anchoring surface disposed adjacent the inside surface of said glass panel and extending essentially perpendicularly to said glass panel, each window grille anchoring surface having a longitudinally extending shallow groove of constant cross-section, each catch means being a one-piece plastic molded catch member comprising a head portion and a stem for securing said catch member to an end of said grille member, said head portion having a broad flat base whose inner surface is adapted to bear against the end surface of said grille member, said head portion also comprising a resilient arcuate arm formed integrally with and overlying said base and being resiliently movable toward and away from said base, said resilient arm being smooth and being so shaped as to remain captive within the shallow grooves of said opposite sash members when said grille member is mounted in place in said window sash, the stem of each catch member being rigid, of constant circular cross-section and having four longitudinally extending radial ribs which are evenly distributed around said stem whose free end is rounded, and each rib being of constant triangular cross-section and terminating short of the tip of said stem such that said stem may be easily inserted into a mounting hole in said grille member of a diameter equal to that of said stem and yet be held against rotation without appreciably stressing said grille member.

10. The combination of a rectangular window, a decorative grille and at least two catch means secured to opposite edges of a member of said decorative grille for retaining said decorative grille across the inside surface of said window, characterized in that said window presents inwardly facing surfaces around the inside surface of the glass panel of said window, at least two opposite ones of said surface comprising a longitudinally extending shallow groove adapted to form a seat for said catch means, characterized in that said decorative grille member extends between said two opposite surfaces, and characterized further in that each catch means is a one-piece molded catch member having a convex head portion and a stem for securing said catch member to an end of said member of said decorative grille, said head portion comprising a base and an arcuate resilient arm overlying said base in a flattened C-shaped configuration, the inner surface of said head section for bearing against the extremity of said member of said decorative grille, said resilient arm being formed integrally with said base and being displaceable relative to said base generally in the direction extending through both catch members, said resilient arm having its outer surface smooth and so shaped as to remain captive within the adjacent one of said shallow grooves when said decorative grille is mounted in place against or adjacent the inside surface of said glass panel while being sufficiently flexible as to yield when said decorative grille is mounted in place against or adjacent the inside surface of said glass panel, the stem of each catch member being rigid, of constant circular cross-section and having four longitudinally extending radial ribs which are evenly distributed around said stem whose free end is rounded, and each rib being of constant triangular cross-section and terminating short of the tip of said stem such that said stem may be easily inserted into a mounting hole in said grille member of a diameter equal to that of said stem and be held against rotation without appreciably stressing said grille member.

11. The combination defined in claim 10 wherein said shallow grooves are arcuate in cross-section and wherein the arm of each catch member is curved in one direction in such a manner as to generally conform to said grooves.

12. The combination defined in claim 11 wherein said decorative grille consists of an assembly of interconnected strips of wood of essentially rectangular constant cross-section arranged into a grid configuration, at least two parallel ones of said strips having catch members secured to their opposite ends.

13. The combination defined in claim 12 wherein said window comprises a wooden sash made of two vertical sash members and two horizontal sash members interconnected at their ends to form a rectangular sash and defining a seat for receiving said glass panel therein, said glass panel consisting of an assembly of at least two parallel, juxtaposed glass panes, and a wooden moulding strip secured to said sash members along the inside margin of said glass panel assembly for retaining same within said rectangular sash, said moulding strip having a surface which extends perpendicularly to said glass panel assembly and which defines said shallow groove.

14. A one-piece plastic molded catch member for mounting a decorative grille to a window whose sash presents along at least two opposite sides thereof an inwardly facing shallow groove extending parallel to the plane of the window glass pane, said catch member comprising an elongate stem and a convex head portion disposed over one end of said stem in a T-shaped configuration, said head portion consisting of a relatively broad base and a convex arm overlying said base and connected to one edge thereof generally in a flattened C-shaped configuration, said stem being essentially solid and rigid, being of constant circular cross-section, and said stem having four longitudinally extending radial ribs which are evenly distributed around said stem whose free end is rounded, and each rib being of constant triangular cross-section and terminating short of the tip of said stem, such that said stem may be easily inserted into a mounting hole in said grille of a diameter equal to that of said stem and be held against rotation without appreciably stressing said grille member.

15. A one-piece plastic molded catch member for mounting a decorative grille or the like to the sash of a window which has along each of at least two of its opposite sash members an inwardly facing surface which together with the inside surface of the glass panel of said window forms a wide shallow recess for receiving said decorative grille, and a shallow groove extending along each of said inwardly facing surfaces for receiving said catch member, said catch member comprising a head portion and a stem integrally formed therewith for frictionally securing said catch member to an end of said decorative grille into which an axial bore of suitable diameter and depth has been provided therefor, said head portion comprising a base adapted to bear against an end of said decorative grille and an arcuate flexible arm secured to one edge of said base and overlying said base, the groove engaging surface of said arm being smooth and conforming to the shape of said shallow groove, said stem being essentially solid and rigid, being of constant circular cross-section and said stem having four longitudinally extending radial ribs which are evenly distributed around said stem whose free end is rounded, and each rib being of constant triangular cross-section and terminating short of the tip of said stem such that said stem may be easily inserted into said axial bore and be held against rotation within said bore without appreciably stressing said grille.

* * * * *